US010488129B2

(12) United States Patent
Myers et al.

(10) Patent No.: US 10,488,129 B2
(45) Date of Patent: Nov. 26, 2019

(54) ADJUSTABLE WEIGHT FIREARM RECOIL BUFFER USING FILL MATERIAL

(71) Applicant: Spike's Tactical, LLC, Apopka, FL (US)

(72) Inventors: James Randy Myers, Altamonte Springs, FL (US); Gregory Schmell, Souderton, PA (US)

(73) Assignee: Spike's Tactical, LLC, Apopka, FL (US)

( * ) Notice: Subject to any disclaimer, the term of this patent is extended or adjusted under 35 U.S.C. 154(b) by 0 days.

(21) Appl. No.: 15/974,730

(22) Filed: May 9, 2018

(65) Prior Publication Data

US 2018/0328682 A1 Nov. 15, 2018

Related U.S. Application Data

(60) Provisional application No. 62/506,008, filed on May 15, 2017.

(51) Int. Cl.
*F41A 3/78* (2006.01)
*F41A 3/80* (2006.01)

(52) U.S. Cl.
CPC ..... *F41A 3/80* (2013.01)

(58) Field of Classification Search
CPC ..... F41A 3/84; F41A 3/70; F41A 3/12; F41A 3/94; F41A 3/80; F41A 25/12
USPC ..... 42/1.06; 89/198
See application file for complete search history.

(56) References Cited

U.S. PATENT DOCUMENTS

| | | | | | |
|---|---|---|---|---|---|
| 2,434,972 | A * | 1/1948 | Vick | F41A 5/32 | 89/24 |
| 2,442,371 | A * | 6/1948 | Meyers | F41A 25/18 | 89/43.01 |
| 2,454,251 | A * | 11/1948 | Hamilton | F41A 3/40 | 89/159 |
| 2,590,897 | A * | 4/1952 | Simpson | F41F 3/0455 | 42/105 |
| 4,974,493 | A * | 12/1990 | Yeffman | F41A 3/78 | 89/198 |
| 5,909,002 | A | 6/1999 | Atchisson | | |
| 7,131,367 | B1 | 11/2006 | Boerschig et al. | | |
| 8,104,568 | B2 * | 1/2012 | Luchini | G01V 1/147 | 181/106 |
| 8,296,984 | B2 | 10/2012 | Kincel | | |
| 9,080,823 | B1 | 7/2015 | Mantas | | |
| 2011/0154707 | A1 * | 6/2011 | Noonan | B29C 41/04 | 42/1.06 |

(Continued)

FOREIGN PATENT DOCUMENTS

| | | | | |
|---|---|---|---|---|
| DE | 102011017271 | * | 4/2011 | F41A 3/78 |
| GB | 1021109 A | * | 2/1966 | F41A 3/46 |
| WO | WO-2012139936 A1 | * | 10/2012 | F41A 3/80 |

*Primary Examiner* — Michael D David

(74) *Attorney, Agent, or Firm* — Wood Herron & Evans LLP

(57) ABSTRACT

A firearm recoil buffer having a tubular body with a closed end, an open end, and an interior surface including an inset notch adjacent the open end. Fill material is provided in the tubular body to add a preselected amount of weight. A closure member has an attachment portion with a pawl portion that connectably engages the inset notch when the closure member is assembled by pressing into the tubular body.

8 Claims, 3 Drawing Sheets

(56) References Cited

U.S. PATENT DOCUMENTS

| | | | |
|---|---|---|---|
| 2013/0192114 | A1 | 8/2013 | Christenson |
| 2014/0224112 | A1 | 8/2014 | Verry |

* cited by examiner

ADJUSTABLE WEIGHT FIREARM RECOIL BUFFER USING FILL MATERIAL

RELATED APPLICATIONS

This application claims priority to U.S. Provisional Patent Application No. 62/506,008, filed May 15, 2017, and incorporates the same herein by reference.

TECHNICAL FIELD

This invention relates to a recoil buffer of the type typically used in conjunction with a recoil spring in an AR-pattern firearm. More particularly, it relates to the construction and method of assembly of such a buffer.

BACKGROUND

In a typical AR-pattern firearm, in which a recoil spring is located in either the butt stock or a tubular extension of the receiver aft of a bolt carrier assembly, a recoil buffer may serve multiple purposes. In general, the buffer is a reciprocating mass that provides an interface between the recoil spring and the rear end of the reciprocating bolt carrier. The buffer and recoil spring typically remain captive within the butt stock or a tubular extension of the receiver so that an upper receiver, that houses the bolt carrier, and a lower receiver, to which the butt stock or extension tube is attached, are easily separated and reassembled.

A head portion of the buffer provides a forward contact surface for contact with the rear end of the bolt carrier and a sliding surface that guides the buffer within the extension tube. The body of the buffer that is orientated rearwardly relative to a head portion is received within the helical recoil spring. The tubular body is generally provided in two standard lengths: rifle and carbine. The aft end of the buffer typically includes a bumper made of at least somewhat resilient material to absorb some impact when the recoil spring has been compressed to the length of the buffer body and the reciprocating mass (buffer and bolt carrier assembly) reaches the end of its recoil stroke.

It is possible to "tune" how the firearm cycles by adjusting the weight of the reciprocating mass. This is most easily accomplished by choosing a buffer having a selected weight. Typically, the weight of a standard buff is from about 3 ounces for a carbine to 8 ounces or more for specialized rifle buffers. Increasing the buffer weight of the reciprocating mass can provide noticeable reduction in felt recoil and muzzle movement. Providing additional mass can also aid feeding of ammunition cartridges during the loading cycle. Specialized buffer designs having moving parts or pistons have also been used.

Traditionally, a standard recoil buffer has been constructed from four component parts: a tubular body having a closed forward end and an opposite open end, a plug used to close the open end and to provide a bumper at the aft end, a cross pin used to secure the closure plug to the body, and an internal weight or weights. The tubular body is typically machined from metal stock (such as an aluminum alloy). The cross pin is typically a roll pin that extends through a transverse opening in the plug that is aligned with opposite openings in the tubular sidewalls of the body adjacent the open end. The internal weight is typically three or more solid pieces sized to fit within the tubular body, each being made from steal or tungsten so that a combination of pieces, depending on material, will provide a selected total weight for the buffer. Typically, the body, plug, and roll pin may make up about 1.2 ounces of the total weight with a combination of steel and/or tungsten inserts providing the balance of the total weight. The traditional buffer is assembled by providing the metal tubular body, inserting a selected combination of weights, inserting the plug/bumper, and then hammering a roll pin into place to secure the plug. Alternative constructions have used a threaded engagement between the plug and body. Each of these is a removable engagement that may be disassembled but, as a result, may also come apart when unintended.

SUMMARY OF THE INVENTION

The present invention provides a simple construction of a buffer that is low cost, can be made in any selected weight, and is easy to manufacture and assemble.

The recoil buffer can have a tubular body with a closed end, an open end, and an interior surface including an inset notch adjacent the open end. Fill material is provided in the tubular body to add a preselected amount of weight. A closure member can include an attachment portion with a pawl portion that connectably engages the inset notch when the closure member is assembled by pressing into the tubular body. The closure member can also include a bumper portion that extends outward beyond the open end when the closure member is assembled to the tubular body.

According to a method the present invention, assembling a firearm recoil buffer may comprise providing a tubular body with a closed end and an open end, an interior surface of the body including an inset notch adjacent the open end. Fill material is inserted into the tubular body to add a selected amount of weight. A closure member having an attachment portion is provided. The attachment portion may have a pawl portion configured to connectably engage the inset notch when the closure member is assembled by pressing into the tubular body. Pressing the closure member into the open end of the tubular body to engage the pawl portion in the inset notch, fixes the closure member in place to contain the fill material.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
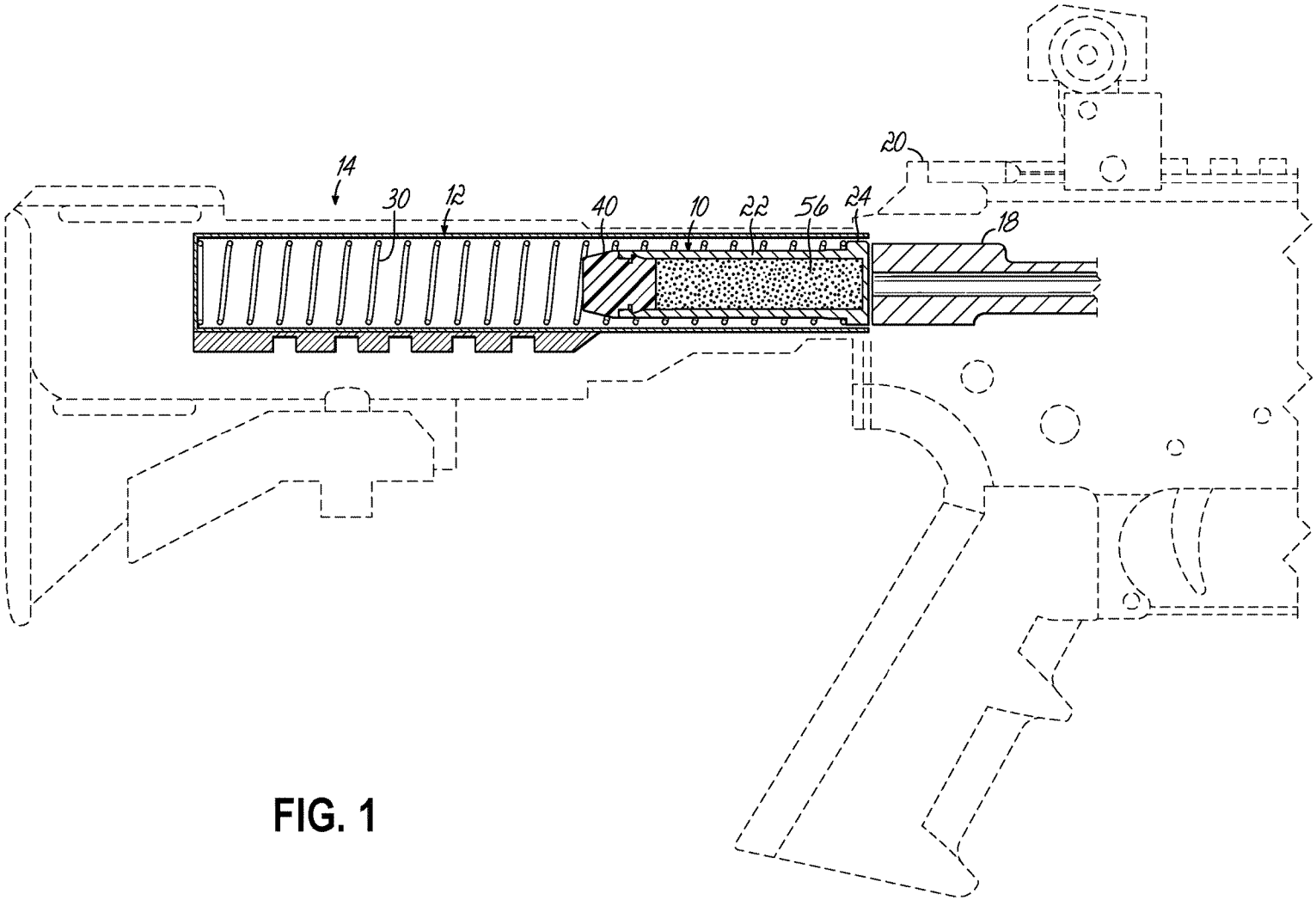
FIG. 1 is a fragmentary, partially sectioned schematic side view of a recoil buffer according to one embodiment of the present invention assembled with a recoil spring in a butt stock of an AR-pattern firearm.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
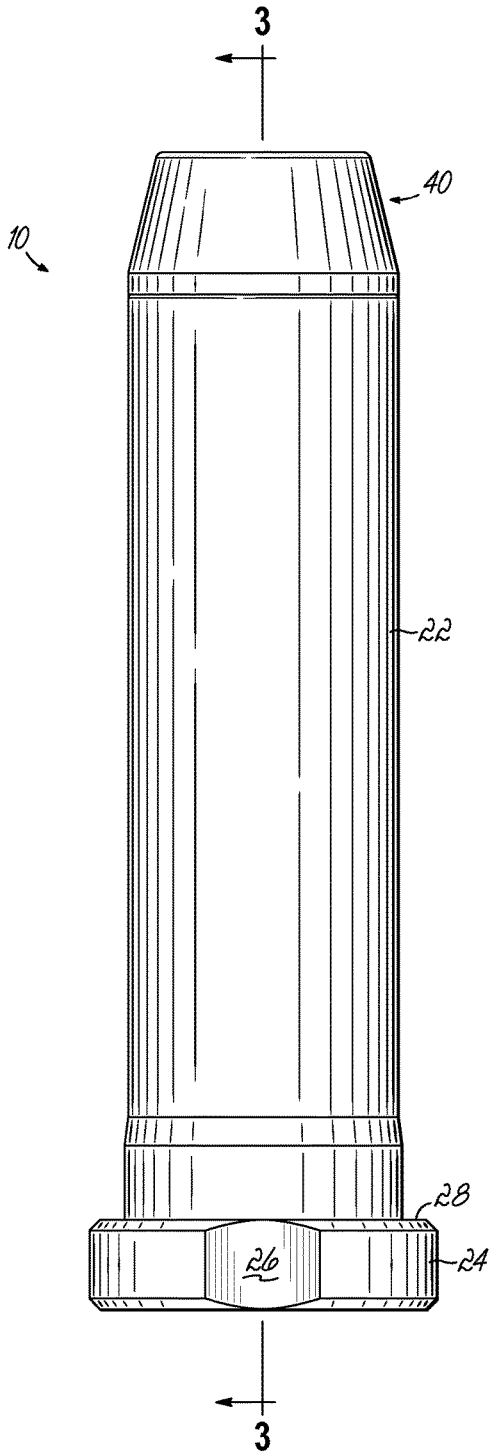
FIG. 2 is a side view of an assembled buffer according to one embodiment of the present invention.
Figure 3:
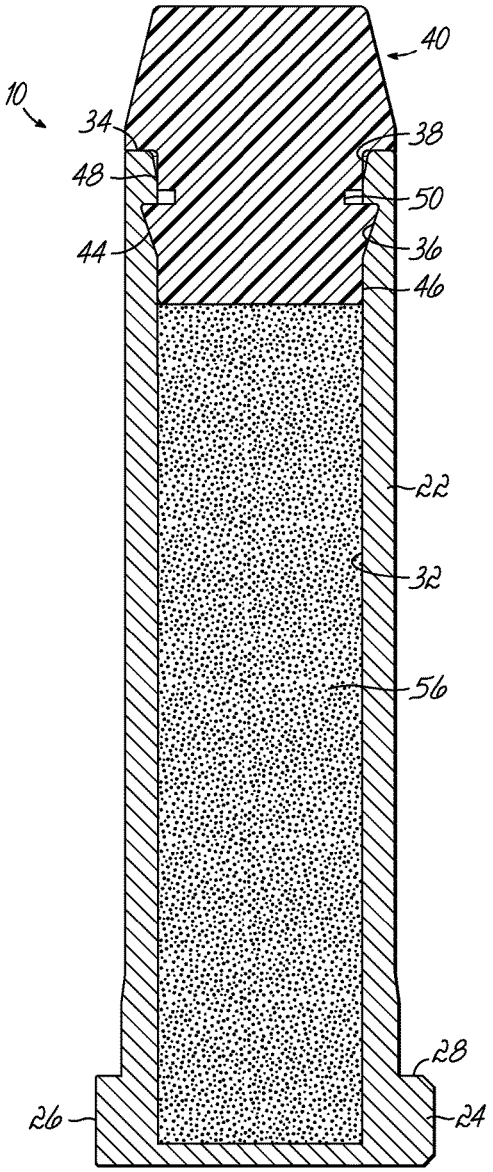
FIG. 3 is a side sectional view thereof taken substantially along line 3-3 of FIG. 2.
Figure 5:
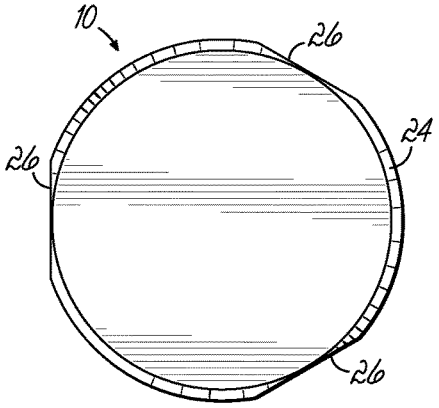
FIG. 5 is a front end view thereof.

Referring first to FIG. 1, therein is shown at 10 a buffer depicted as assembled in a tubular receiver extension 12 that is part of a butt stock 14 of an AR-pattern rifle (shown in phantom line). The tubular receiver extension 12 is mounted to and extends from a lower receiver 16. A bolt carrier assembly 18 is housed by an upper receiver 20, substantially in axial alignment with the buffer 10 and tubular receiver extension 12. Referring now also to FIGS. 2, 3, and 5, the buffer 10 includes a substantially tubular body 22 having an enlarged diameter head portion 24 at a first closed end thereof. The head portion 24 may include a plurality of flats 26, but has a general overall diameter sized to be guided within the tubular receiver extension 12.

The head portion 24 provides an annular shoulder 28 against which one end of the recoil spring 30 abuts when slipped over the body 22 of the buffer 10. The body 22 of the present invention may be machined from metal or molded, such as by injection molding, from a polymer plastic material. For example, it may be molded of an acetal homopolymer resin (e.g., DuPont™ Delrin®), a material that is durable and self-lubricating. Alternatively, the body 22 can be machined from metal (such as steel or an aluminum alloy) and, typically, anodized or otherwise treated/coated to provide a durable and/or lubricious surface. The head portion 24 provides a closed end to the tubular body 22 to define an inner chamber 32 with an open end 34 opposite the head portion 24. The exterior of the tubular body 22 is generally cylindrical to fit within and guide the helical recoil spring 30 or may be slightly tapered to narrow toward the open end 34. The illustrated tubular body 22 will provide a carbine length buffer, although it can be elongated to provide a rifle length buffer.

A feature of this embodiment includes an annular grove 36 positioned on the inner surface of the tubular body 22 adjacent to, but slightly inset from, the open end 34. If desired, the inner edge of the open end 34 may include a beveled portion 38. Also, according to a feature of the present invention, the open end 34 may be closed by a snap-fit closure plug 40, which also acts as an end-of-stroke bumper. An attachment portion 42 of the closure plug 40 may include an annular pawl 44 configured to snap fit into the annular grove 36 of the body 22. The pawl 44 may be in the form a continuous angled surface encircling a portion of the closure plug 40, or may be a series of separate circumferentially spaced pawls (not shown). The attachment portion 42 may also include a leading guide portion 46 and a following guide portion 48 that are sized to closely fit interior surface areas of the tubular body 22 axially inward and outward of the annular grove 36. An outer portion 52 of the closure plug 40 provides an end of stroke bumper for the buffer 10 and may be tapered in a traditional way.

For assembly, the attachment portion 42 of the closure plug 40 is inserted into the open end 34 of the tubular body 22 with sufficient force to temporarily compress or displace the annular pawl until it snaps into the annular grove 36. Optionally, an annular undercut channel 50 may provide additional room for temporarily deformation or displacement of the annular pawl 44 as the closure plug 40 is inserted into place. This manner of securing the closure plug 40 in place to the body 22 is substantially permanent, compared to prior attachment means that include a threaded engagement or insertion of a transverse roll pin. Accordingly, the closure plug 40 is likely to be damaged or destroyed in the process of removal. Given the relatively low cost of manufacturing a buffer 10 according to the present invention, a damaged or improperly weighted unit is likely to simply be discarded, rather than attempt removal of the closure plug 40.

In preferred form, the closure plug 40 is made of a material having at least some resiliency. This aids in engagement of the annular pawl 44 through the open end 34 of the body 22 and gripping engagement in the annular grove 36. Likewise, some resiliency allows the outer portion 52 to absorb and cushion the impact as the buffer 10 and recoil spring 30 reach the end of the reciprocating recoil stroke. Materials such as polyurethane, nylon, or UHMW can be used, for example. Or, for more significant resiliency and cushioning, an elastomeric rubber compound may be selected.

Figure 4:
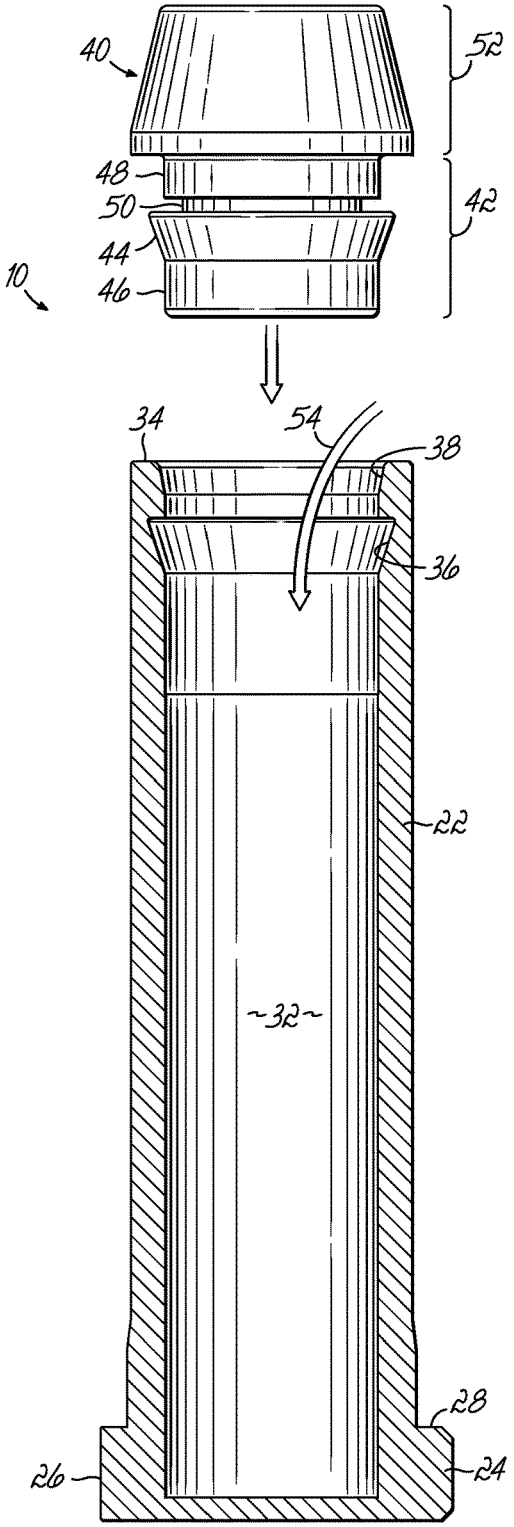
FIG. 4 is an exploded, partially sectioned view thereof schematically illustrating assembly of the buffer.

According to another aspect of the present invention, assembly of the buffer 10 is easier, faster, and requires fewer steps than traditional construction. As schematically shown in FIG. 4, weight is added to the tubular body 22 through the open end 34 (arrow 54). The weight can be in the traditional of one or more solid units, or (as shown in FIG. 3) a granular fill material 56. The fill material 56 may be, for example, coarse-grain powdered tungsten. By using a granular fill material 56, the total weight of the buffer 10 may be more exactly adjusted during assembly. After the selected amount of fill material 56 is added to the inner chamber 32 of the body 22, the closure plug 40 is snapped axially into place in the open end 34 by force.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A firearm recoil buffer, comprising:

a tubular body with a closed end and an open end, the tubular body including an interior surface having an inset notch annular groove adjacent the open end;

fill material in the tubular body to add a selected amount of weight;

a closure member having an attachment, the attachment having a pawl comprising an annular ridge configured to connectably engage the inset notch annular groove when the closure member is assembled by pressing into the tubular body.

2. The recoil buffer of claim 1, wherein the closure member includes an annular undercut channel that provides room for temporarily displacement of the pawl as the closure member is inserted into the tubular body.

3. The recoil buffer of claim 1, wherein the interior surface includes a tapered portion at the open end, the tapered portion configured to receive the closure member.

4. The recoil buffer of claim 1, wherein the fill material comprises metallic granules.

5. The recoil buffer of claim 4, wherein the metallic granules comprise tungsten.

6. The recoil buffer of claim 1, wherein the closure member includes a bumper portion, the bumper portion extending outward beyond the open end when the closure member is assembled to the tubular body.

7. A method of assembling a firearm recoil buffer, comprising the steps of:

providing a tubular body with a closed end and an open end, the tubular body including an interior surface having an inset notch annular groove adjacent the open end;

inserting fill material in the tubular body to add a selected amount of weight;

providing a closure member having an attachment, the attachment having a pawl including an annular ridge configured to connectably engage the inset notch annular groove when the closure member is assembled by pressing into the tubular body; and pressing the closure member into the open end of the tubular body to engage the pawl in the inset notch annular groove to fix the closure member in place and contain the fill material.

8. The method of claim 7, wherein closure member includes a bumper portion, the bumper portion extending the length of the tubular body outward beyond the open end when the closure member is assembled to the tubular body.

* * * * *